United States Patent [19]

Yates

[11] 4,183,566

[45] Jan. 15, 1980

[54] SEAL LOCK

[75] Inventor: Paul D. Yates, Prospect, Ohio

[73] Assignee: Hercules Industries, Inc., Prospect, Ohio

[21] Appl. No.: 883,521

[22] Filed: Mar. 6, 1978

[51] Int. Cl.[2] ..... B65D 27/30

[52] U.S. Cl. ..... 292/317; 70/50; 292/329

[58] Field of Search ..... 292/322, 324, 319, 307, 292/317, 318, 329, 331; 70/50

[56] References Cited

U.S. PATENT DOCUMENTS

| | | | |
|---|---|---|---|
| 98,917 | 1/1870 | Brooks | 292/329 |
| 112,211 | 2/1871 | Bohannan | 292/329 |
| 139,786 | 6/1873 | Hamilton | 292/329 |
| 152,297 | 6/1874 | Lorimer | 292/329 |
| 306,524 | 10/1884 | Reeve | 292/329 |
| 361,434 | 4/1887 | Mason | 292/329 |
| 2,530,899 | 11/1950 | Mueller | 292/307 R |
| 2,655,805 | 10/1953 | Fletcher | 70/50 |
| 4,049,303 | 9/1977 | Irwin | 292/307 R |

*Primary Examiner*—J. Franklin Foss

*Attorney, Agent, or Firm*—Hume, Clement, Brinks, Willian & Olds, Ltd.

[57] ABSTRACT

A keyless seal lock is disclosed which includes a shackle and a lock body. The lock body is provided with a sliding bolt which secures the shackle to the lock body and substantially prevents removal of the shackle from the lock body without deformation of the lock. The lock shackle is provided with a weakened portion which may be severed in order to remove the lock. Once the shackle has been severed, the shackle may be removed from the lock body without further deformation of the lock. In this manner the seal lock may be removed without damaging the lock body, and the lock body may be reused.

5 Claims, 7 Drawing Figures

SEAL LOCK

BACKGROUND OF THE INVENTION

This invention relates to a keyless seal lock having a reusable lock body.

Padlock-type seal locks have been used to provide protection against theft and unauthorized entry. Such seal locks typically include a shackle and a lock body. The seal lock is applied by inserting the shackle in the lock body and closing the lock like a padlock. Typically these locks are keyless and can only be removed by deforming the lock itself. Since the lock must be deformed to be opened, it can not be surreptitiously opened and reclosed, as can a conventional padlock.

The seal locks described in U.S. Pat. No. 3,602,538 (Canter) and U.S. Pat. No. 3,937,507 (McCoag) are two examples of such seal locks. Both the Canter and the McCoag locks employ shackles which are secured to keyless lock bodies. In both cases the seal lock may be removed by severing the shackle without deforming the lock body. However, in both cases the severed ends of the shackle may not readily be removed from the lock body without deforming the lock body itself. Since the shackle ends may not readily be removed, the lock body may not be reused. Thus, the entire seal lock is nonreusable, and after the shackle has been cut to open the lock, the entire lock, including both the body and shackle, must be replaced. In many applications the high cost of replacing the entire seal lock each time the seal is broken is a disadvantage which has limited the use of seal locks.

SUMMARY OF THE INVENTION

The present invention is directed to a seal lock which includes a reusable lock body and a nonreusable, severable shackle. Securing means are provided for locking the shackle to the lock body in such a way that the shackle cannot be removed from the lock without deforming the lock, preferably by severing the shackle. The lock is also provided with means for overriding the securing means after the shackle has been severed, thereby releasing the severed shackle from the lock body.

The seal lock of this invention is locked like a padlock to create a seal. This seal is preferably broken by severing the shackle and removing the lock. Once the shackle has been severed, it may then be removed from the lock body and the lock body may be reused. In this manner the seal lock may be removed and reapplied merely by replacing the shackle. In many embodiments, the cost of replacing the shackle alone is significantly less than the cost of replacing the entire seal lock including the lock body, and in these embodiments, significant cost reductions are provided by the reusable lock body of this invention.

In the preferred embodiment, it is rotation of a first end of the severed shackle which overrides the securing means and releases the shackle from the lock body. The shackle of this embodiment is weakened at a predetermined place which defines a preferred place for severing the shackle. The weakened portion of the shackle is preferably placed at some distance from the first end of the shackle so that the first end of the shackle may be readily grasped, rotated, and removed after the shackle has been severed.

The invention, together with further objects and attendant advantages, will be best understood by reference to the following description taken in connection with the accompanying drawings.

DETAILED DESCRIPTION OF THE PREFERRED EMBODIMENT

Figure 1:
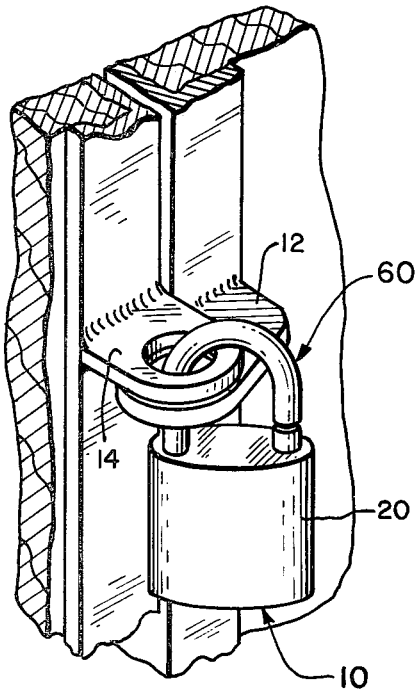
FIG. 1 is a perspective view of a preferred embodiment of the seal lock of this invention.

Referring now to the drawings, FIG. 1 depicts the preferred embodiment of the seal lock 10 of this invention. The seal lock 10 includes a lock body 20 and a shackle 60. The shackle 60 may be secured to the lock body 20 in order to seal a plurality of aperture defining members 12, 14, as shown.

Figure 6:
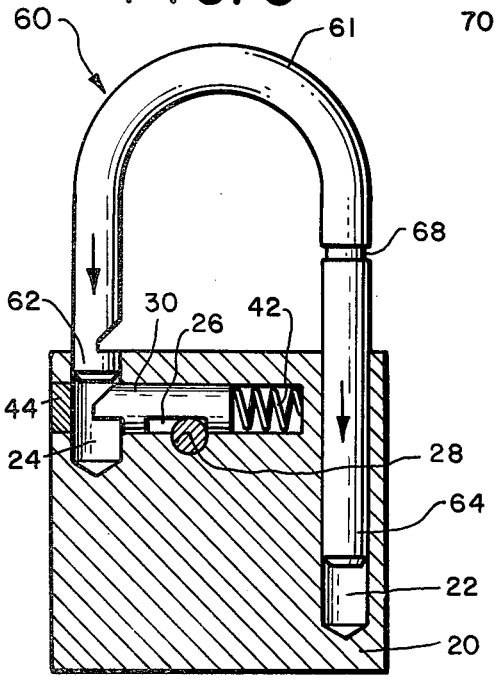
FIG. 6 is a cutaway view of the lock of FIG. 1 showing the lock before the shackle is secured to the lock body.

As best seen in FIG. 6, the lock body 20 defines four cavities: first and second shackle cavities 22, 24, a bolt cavity 26, and a pin cavity 28. The first and second shackle cavities 22, 24 are dimensioned to receive the two end sections 64, 62 of the shackle 60. The bolt cavity 26 is positioned transverse to the second shackle cavity 24, and is sized to receive a cylindrical bolt 30. The limits of travel of the bolt 30 in the bolt cavity 26 are defined by a pin 46 which is placed in the pin cavity 28 so as to partially protrude into the bolt cavity 26.

Figure 2:
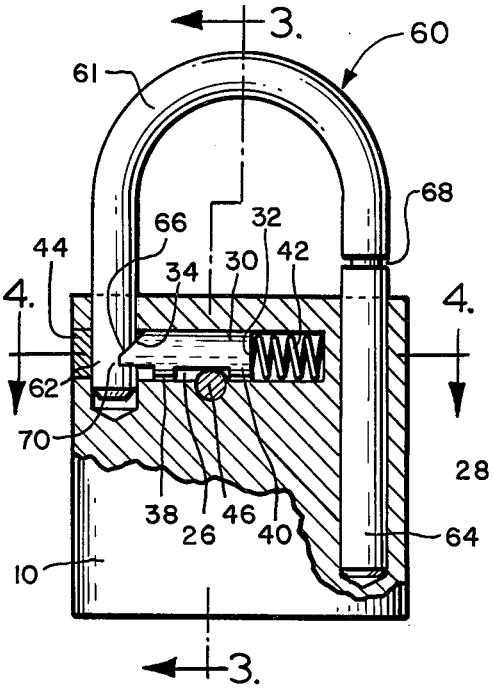
FIG. 2 is a cutaway view of the lock of FIG. 1 showing the shackle secured to the lock body.

As shown in FIG. 2, the bolt 30 defines a flat surface 32 at one end and a bevelled surface 34 at the other. A recess 36 is defined in the bolt 30, and this recess is bounded by first and second projecting faces, 38 and 40, respectively. The bolt 30 is urged toward the second shackle cavity 24 by the spring 42.

The shackle 60 includes a curved central section 61 and two substantially parallel end sections 62, 64. Both end sections 62, 64 are cylindrical in cross section, and the shorter end section 62 defines a notch 66 which is adapted to receive the bevelled surface 34 of the bolt 30 and extends only over the inner portion of the end section 62. The end section 62 also defines a bearing surface 70 at the apex of the notch 66. A circumferential groove 68 is formed in the portion of the longer end section 64 which extends above the lock body 20 when the shackle 60 is secured to the lock body 20.

Figure 3:
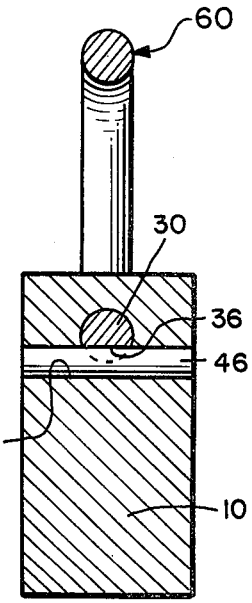
FIG. 3 is a sectional view taken along line 3—3 of FIG. 2.

The lock body 20 is assembled by placing the spring 42 and the bolt 30 in the bolt cavity 26, compressing the spring 42, and then inserting the pin 46 in the pin cavity 28. The portion of the bolt cavity 26 which extends beyond the second shackle cavity 24 is then plugged with a plug 44. As shown in FIG. 3, the movement of the bolt 30 is restricted by the pin 46, and the first and second projecting faces 38, 40 of the bolt 30. The pin 46 also restricts the rotation of the bolt 30 in the bolt cavity 26 and insures proper orientation of the bevelled surface 34.

Figure 4:
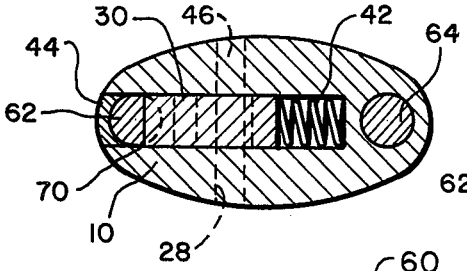
FIG. 4 is a sectional view taken along line 4—4 of FIG. 2.

In use the seal lock of this invention provides a reusable lock body 20 which cooperates with a severable shackle 60 to create a seal which cannot be removed without deformation of the lock. Before the shackle 60 is secured to the lock body 20, the shackle 60 and lock body 20 form two separate pieces which may be readily separated. As shown in FIG. 6, the bolt 30 is urged by the spring 42 into the shackle cavity 24. When the two end sections 62, 64 of the shackle 60 are inserted into the two shackle cavities 24, 22, the end section 62 contacts the bevelled surface 34 and forces the bolt 30 back into the bolt cavity 26 until the notch 66 reaches the level of the bolt 30. At this point the bolt 30 is urged by the spring 42 into the notch 66, thereby securing the lock shackle 60 to the lock body 20. FIGS. 2 and 4 depict the shackle 60 secured to the lock body 20 by the bolt 30.

Figure 5A:
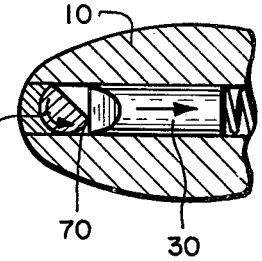
FIG. 5A is a cutaway view taken in the plane of FIG. 4 showing the severed shackle in an intermediate position of rotation.
Figure 5:
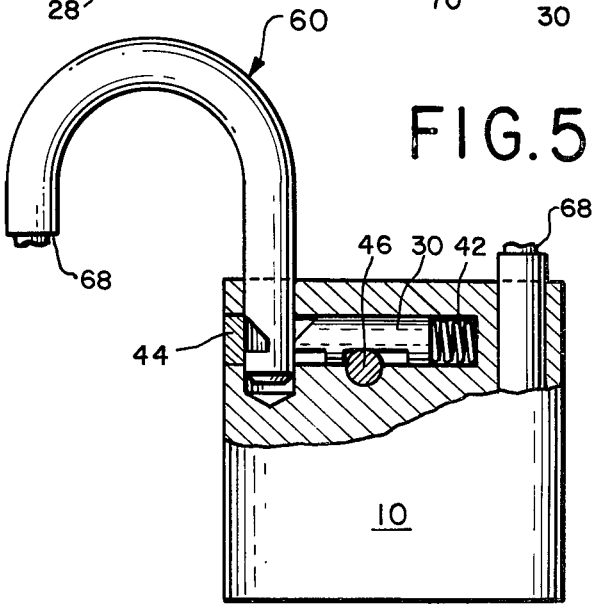
FIG. 5 is a cutaway view of the lock of FIG. 1, showing the severed shackle fully rotated and released from the lock body.

Once the bolt 30 has entered the notch 66 the seal lock 10 cannot be opened without deforming the lock. Preferably, the lock is deformed by severing the shackle 60 at the groove 68. The groove 68 weakens the shackle 60, making it more readily severable at this point. Once the shackle 60 has been severed, the end section 62 is rotated in order to override the securing means and release this portion of the shackle 60 from the lock body 10. As shown in FIGS. 5 and 5A, rotation of the shackle end section 62 causes the bearing surface 70 to contact the bevelled surface 34 of the bolt 30. Continued rotation of the end section 62 forces the bolt 30 back into the bolt cavity 26 and out of the notch 66. When the bolt 30 has been completely disengaged from the notch 66, the end section 62 may be readily removed from the lock body 20. When the shackle 60 is severed at the groove 68, the curved section 61 of the shackle 60 remains attached to the end section 62 and serves as a handle by which the end section 62 may be grasped, rotated, and removed. The end section 64 is also readily removable from the lock body 20, since it is free to move in the first shackle cavity 22. Thus, both ends of the severed shackle 60 may be readily removed from the lock body 20, and the lock body thereby readied for reuse with another shackle.

Depending on the application, the seal lock of this invention may be constructed from a wide range of materials. Plastic materials or soft metals, such as brass, may be used if the sealing function is more important than the locking function. Alternately, hard metals, such as steel, may be used to make a seal lock which provides a sealing function and is also difficult to deform. The choice of the particular materials suitable for an individual application is well within the ability of one of ordinary skill in the lockmaking art; however, a seal lock in which the lock body 20, shackle 60, and bolt 30 are fabricated from brass provides a lock with a moderate resistance to deformation which is suitable for many applications.

Of course, it should be understood that various changes and modifications to the preferred embodiment described herein will be apparent to those skilled in the art. Such changes and modifications can be made without departing from the scope of the present invention and without diminishing its attendant advantages. It is, therefore, intended that such changes and modifications be covered by the following claims.

I claim:

1. A keyless lock comprising:

a shackle having first and second substantially parallel end sections, said first end section defining a notch;

a unitary lock body defining first and second substantially parallel receiving cavities positioned to receive the first and second end sections, respectively, and further defining a bolt cavity positioned to intersect the first receiving cavity;

a bolt slidably positioned in the bolt cavity, said bolt having a beveled end portion adjacent the first receiving cavity;

a spring disposed in the bolt cavity and operative to urge the bolt toward the first receiving cavity, said spring acting to hold the beveled end portion of the bolt in the notch in the first end section of the shackle when the shackle is inserted in the first and second receiving cavities;

a bearing surface on said first end section adjacent the notch, which bearing surface operates to disengage the bolt from the notch when the first end section is rotated in the first receiving cavity, such that the first end section may be removed from the lock body after the shackle has been severed without deformation of the lock body.

2. The keyless lock of claim 1 further including a region of the second end section of the shackle which is more readily severable than other regions of the second end section and is distinctively marked.

3. The keyless lock of claim 1 wherein the first and second receiving cavities, the bolt cavity, the first and second end sections and the bolt are substantially cylindrical;

the bolt defines a recess on one cylindrical surface;

the lock body defines a pin cavity positioned to intersect the bolt cavity; and a pin is positioned in the pin cavity to pass through the recess in the bolt to limit the rotational and sliding movement of the bolt in the bolt cavity.

4. A keyless lock comprising:

a shackle having first and second substantially parallel end sections, said first end section having a substantially circular cross section and defining a notch;

a unitary lock body defining first and second, substantially parallel, receiving cavities positioned to receive the first and second end sections, respectively, said lock body further defining a bolt cavity positioned to intersect the first receiving cavity and a pin cavity positioned to intersect the bolt cavity;

a bolt slidably positioned in the bolt cavity, said bolt having a beveled end portion adjacent the first receiving cavity;

a spring disposed in the bolt cavity and operative to urge the bolt toward the first receiving cavity and into engagement with the notch in the first end section to substantially prevent removal of the inserted shackle from the lock body without deformation of the lock;

a pin disposed in the pin cavity to pass through the recess in the bolt to limit the rotational and sliding movement of the bolt in the bolt cavity; and a bearing surface on said first end section adjacent the notch, which bearing surface operates to disengage the bolt from the notch when the first end section is rotated in the first cavity such that the first end section may be removed from the lock body after the shackle has been severed without deformation of the lock body.

5. The keyless lock of claim 4 wherein the shackle is provided with a region which is more readily severable than other regions of the shackle, wherein said more readily severable region is distinctively marked.

* * * * *